US011089812B2

(12) United States Patent
Zuber et al.

(10) Patent No.: US 11,089,812 B2
(45) Date of Patent: Aug. 17, 2021

(54) AEROSOL-GENERATING ARTICLE HAVING AN AEROSOL-COOLING ELEMENT

(71) Applicant: Philip Morris Products S.A., Neuchatel (CH)

(72) Inventors: Gerard Zuber, Froideville (CH); Cedric Meyer, Lausanne (CH); Daniele Sanna, Castel Maggiore-Bologna (IT); Alexis Louvet, Lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/378,466

(22) PCT Filed: Dec. 28, 2012

(86) PCT No.: PCT/EP2012/077086
§ 371 (c)(1),
(2) Date: Aug. 13, 2014

(87) PCT Pub. No.: WO2013/120565
PCT Pub. Date: Aug. 22, 2013

(65) Prior Publication Data

US 2015/0027474 A1 Jan. 29, 2015

(30) Foreign Application Priority Data

Feb. 13, 2012 (EP) ..... 12155248

(51) Int. Cl.
*A24D 1/20* (2020.01)
*A24F 42/10* (2020.01)
(Continued)

(52) U.S. Cl.
CPC ..... *A24D 3/04* (2013.01); *A24D 1/20* (2020.01); *A24D 1/22* (2020.01); *A24D 3/10* (2013.01); *A24D 3/17* (2020.01); *A24F 42/10* (2020.01)

(58) Field of Classification Search
None
See application file for complete search history.

(56) References Cited

U.S. PATENT DOCUMENTS 2,001,709 A * 5/1935 Glenn Davidson ..... 131/361
2,039,298 A 5/1936 Davidson
(Continued)

FOREIGN PATENT DOCUMENTS

CH 649 032 A5 4/1985
CH 670 420 A5 6/1989
(Continued)

OTHER PUBLICATIONS

U.S. Appl. No. 14/363,093, filed Jun. 5, 2014, Zuber et al.
(Continued)

*Primary Examiner* — Michael J Felton
(74) *Attorney, Agent, or Firm* — Oblon, McClelland, Maier & Neustadt, L.L.P.

(57) ABSTRACT

An aerosol-generating article is provided, including a plurality of elements assembled in the form of a rod, the elements including an aerosol-forming substrate and an aerosol-cooling element located downstream from the aerosol-forming substrate. The aerosol-cooling element includes a plurality of longitudinally extending channels and has a porosity of between 50% and 90% in the longitudinal direction. The aerosol-cooling element may have a total surface area of between about 300 $mm^2$ per mm length and about 1000 $mm^2$ per mm length. An aerosol passing through the aerosol-cooling element is cooled, and in some embodi-
(Continued)

ments, water is condensed within the aerosol-cooling element.

5 Claims, 6 Drawing Sheets

(51) Int. Cl.

| | |
|---|---|
| ***A24D 3/04*** | (2006.01) |
| ***A24D 1/22*** | (2020.01) |
| ***A24D 3/17*** | (2020.01) |
| ***A24D 3/10*** | (2006.01) |

(56) References Cited

U.S. PATENT DOCUMENTS

| | | | | |
|---|---|---|---|---|
| 2,164,702 | A | | 7/1939 | Davidson |
| 2,827,903 | A | | 3/1958 | Niederman H |
| 2,852,987 | A | | 9/1958 | Eislingen et al. |
| 2,992,648 | A | | 7/1961 | Weiss et al. |
| 2,995,481 | A | | 8/1961 | Müller |
| 3,122,145 | A | | 2/1964 | Louis |
| 3,238,852 | A | | 3/1966 | Schur et al. |
| 3,240,213 | A | | 3/1966 | Miller |
| 3,246,655 | A | | 4/1966 | Spears |
| 3,472,236 | A | | 10/1969 | Dearsley |
| 3,518,921 | A | | 7/1970 | Müller |
| 3,744,497 | A | | 7/1973 | Marciuliano |
| 3,818,809 | A | | 6/1974 | Sylvester |
| 3,860,012 | A | | 1/1975 | Selke |
| 3,894,544 | A | | 7/1975 | Egri |
| 3,894,545 | A | | 7/1975 | Crellin et al. |
| 3,957,062 | A | | 5/1976 | Labbe et al. |
| 3,991,773 | A | | 11/1976 | Walker |
| 4,000,748 | A | | 1/1977 | Summers |
| 4,003,684 | A | | 1/1977 | Muller et al. |
| 4,007,745 | A | | 2/1977 | Randall et al. |
| 4,047,536 | A | | 9/1977 | Asfour |
| 4,168,712 | A | | 9/1979 | Labbë |
| 4,281,671 | A | | 8/1981 | Bynre et al. |
| 4,289,725 | A | | 9/1981 | Müller et al. |
| 4,291,711 | A | | 9/1981 | Berger |
| 4,355,995 | A | | 10/1982 | Berger |
| 4,391,285 | A | | 7/1983 | Burnett et al. |
| 4,807,808 | A | | 2/1989 | Reed |
| 4,807,809 | A | * | 2/1989 | Pryor et al. ..... 131/84.1 |
| 4,819,665 | A | * | 4/1989 | Roberts ..... A24F 47/004 131/194 |
| 4,903,714 | A | | 2/1990 | Barnes et al. |
| 4,913,169 | A | | 4/1990 | Templeton |
| 4,928,714 | A | | 5/1990 | Shannon |
| 5,016,656 | A | | 5/1991 | McMurtrie et al. |
| 5,027,837 | A | | 7/1991 | Clearman et al. |
| 5,033,484 | A | | 7/1991 | Seidel et al. |
| 5,101,839 | A | | 4/1992 | Jakob et al. |
| 5,105,837 | A | | 4/1992 | Barnes et al. |
| 5,144,962 | A | | 9/1992 | Counts et al. |
| 5,247,947 | A | | 9/1993 | Clearman |
| 5,261,425 | A | | 11/1993 | Raker |
| 5,271,419 | A | | 12/1993 | Arzonico et al. |
| 5,322,075 | A | | 6/1994 | Deevi et al. |
| 5,360,023 | A | | 11/1994 | Blakley et al. |
| 5,388,594 | A | | 2/1995 | Counts et al. |
| 5,413,121 | A | | 5/1995 | Dawson et al. |
| 5,433,224 | A | | 7/1995 | Luke et al. |
| 5,469,871 | A | | 11/1995 | Barnes et al. |
| 5,499,636 | A | * | 3/1996 | Baggett et al. ..... 131/374 |
| 5,505,214 | A | | 4/1996 | Collins et al. |
| 5,613,504 | A | | 3/1997 | Collins et al. |
| 5,671,757 | A | | 9/1997 | Woodings |
| 5,685,323 | A | | 11/1997 | Crooks et al. |
| 5,692,526 | A | | 12/1997 | Adams et al. |
| 5,709,227 | A | * | 1/1998 | Arzonico ..... A24D 3/068 131/331 |
| 5,724,998 | A | | 3/1998 | Gellatly et al. |
| 5,819,751 | A | | 10/1998 | Barnes et al. |
| 6,026,820 | A | | 2/2000 | Bagget, Jr. et al. |
| 6,385,333 | B1 | * | 5/2002 | Puckett ..... A24C 5/3412 356/237.1 |
| 6,761,175 | B2 | | 7/2004 | Nakanishi et al. |
| 6,857,431 | B2 | | 2/2005 | Deevi |
| 7,998,274 | B2 | | 8/2011 | Rodrigues et al. |
| 2002/0096300 | A1 | | 7/2002 | Yamashita |
| 2003/0154991 | A1 | | 8/2003 | Fournier et al. |
| 2004/0194792 | A1 | | 10/2004 | Zhuang et al. |
| 2005/0039767 | A1 | | 2/2005 | Mua et al. |
| 2005/0066985 | A1 | | 3/2005 | Borschke et al. |
| 2005/0072438 | A1 | | 4/2005 | Darwish |
| 2005/0172976 | A1 | | 8/2005 | Newman et al. |
| 2006/0011206 | A1 | | 1/2006 | Clarke |
| 2006/0021624 | A1 | | 2/2006 | Gonterman et al. |
| 2006/0185687 | A1 | | 8/2006 | Hearn et al. |
| 2007/0023056 | A1 | | 2/2007 | Cantrell et al. |
| 2007/0235050 | A1 | | 10/2007 | Li et al. |
| 2008/0029114 | A1 | | 2/2008 | Seitert et al. |
| 2008/0092912 | A1 | | 4/2008 | Robinson et al. |
| 2008/0163879 | A1 | | 7/2008 | Rodrigues et al. |
| 2009/0038629 | A1 | | 2/2009 | Ergle et al. |
| 2009/0044817 | A1 | | 2/2009 | Besso et al. |
| 2009/0065011 | A1 | | 3/2009 | Maeder et al. |
| 2009/0301503 | A1 | | 12/2009 | Peter et al. |
| 2010/0024834 | A1 | | 2/2010 | Oglesby et al. |
| 2010/0059070 | A1 | | 3/2010 | Potter et al. |
| 2010/0059074 | A1 | | 3/2010 | Brantley et al. |
| 2010/0154809 | A1 | | 6/2010 | Seitert et al. |
| 2010/0200006 | A1 | | 8/2010 | Robinson et al. |
| 2010/0275935 | A1 | | 11/2010 | Fiebelkorn |
| 2010/0313901 | A1 | | 12/2010 | Fernando |
| 2011/0036364 | A1 | | 2/2011 | Pienemann et al. |
| 2011/0036367 | A1 | | 2/2011 | Saito et al. |
| 2011/0155718 | A1 | | 6/2011 | Greim et al. |
| 2011/0290269 | A1 | | 12/2011 | Shimizu |
| 2012/0017925 | A1 | | 1/2012 | Sebastian et al. |
| 2012/0031414 | A1 | | 2/2012 | Atchley et al. |
| 2012/0048286 | A1 | | 3/2012 | Luan et al. |
| 2012/0060853 | A1 | | 3/2012 | Robinson et al. |
| 2012/0060855 | A1 | | 3/2012 | Fiebelkorn |
| 2012/0067360 | A1 | | 3/2012 | Conner et al. |
| 2012/0234821 | A1 | | 9/2012 | Shimizu |
| 2012/0247494 | A1 | | 10/2012 | Oglesby et al. |
| 2012/0305015 | A1 | | 12/2012 | Sebastian et al. |
| 2013/0019886 | A1 | | 1/2013 | White et al. |
| 2014/0305448 | A1 | | 10/2014 | Zuber et al. |
| 2015/0027474 | A1 | | 1/2015 | Zuber et al. |

FOREIGN PATENT DOCUMENTS

| | | | |
|---|---|---|---|
| CH | 691 156 | A5 | 5/2001 |
| CN | 1035040 | A | 8/1989 |
| CN | 1059266 | A | 3/1992 |
| CN | 1190335 | A | 8/1998 |
| CN | 1248888 | A | 3/2000 |
| CN | 1262691 | A | 8/2000 |
| CN | 1316205 | A | 10/2001 |
| CN | 1333657 | A | 1/2002 |
| CN | 1113620 | C | 7/2003 |
| CN | 1633247 | A | 6/2005 |
| CN | 1708241 | A | 12/2005 |
| CN | 1744833 | | 3/2006 |
| CN | 1961765 | A | 5/2007 |
| CN | 101094599 | A | 12/2007 |
| CN | 101132823 | A | 2/2008 |
| CN | 201127292 | Y | 10/2008 |
| CN | 101396173 | A | 4/2009 |
| CN | 101437415 | A | 5/2009 |
| CN | 101500441 | A | 8/2009 |
| CN | 101500442 | A | 8/2009 |
| CN | 101500443 | A | 8/2009 |
| CN | 101631478 | A | 1/2010 |
| CN | 201379072 | Y | 1/2010 |
| CN | 101301111 | B | 6/2010 |
| CN | 101778578 | A | 7/2010 |
| CN | 101790329 | A | 7/2010 |
| CN | 101925309 | A | 12/2010 |

(56) References Cited

FOREIGN PATENT DOCUMENTS

| | | | |
|---|---|---|---|
| CN | 101970323 | A | 2/2011 |
| CN | 102088875 | A | 6/2011 |
| CN | 102266121 | A | 12/2011 |
| CN | 102392316 | A | 3/2012 |
| DE | 1 632 239 | B1 | 3/1972 |
| DE | 198 54 009 | A1 | 5/2000 |
| EP | 983928 | | 2/1965 |
| EP | 1197174 | | 7/1970 |
| EP | 2 020 158 | A | 11/1979 |
| EP | 0 212 234 | A2 | 3/1987 |
| EP | 0 307 090 | A1 | 3/1989 |
| EP | 0 340 808 | A2 | 11/1989 |
| EP | 0 342 538 | A2 | 11/1989 |
| EP | 0 471 581 | A1 | 2/1992 |
| EP | 0 476 349 | | 3/1992 |
| EP | 0 503 767 | A1 | 9/1992 |
| EP | 0 532 329 | | 3/1993 |
| EP | 0 535 695 | A2 | 4/1993 |
| EP | 0 530 251 | B1 | 9/1995 |
| EP | 0 777 977 | A2 | 6/1997 |
| EP | 0 822 670 | A2 | 2/1998 |
| EP | 0 822 760 | A2 | 2/1998 |
| EP | 0 608 047 | B1 | 7/1998 |
| EP | 1 889 550 | A1 | 2/2008 |
| EP | 2 025 251 | A1 | 2/2009 |
| EP | 2 062 484 | A1 | 5/2009 |
| EP | 2 100 840 | A1 | 9/2009 |
| EP | 2 289 357 | A1 | 3/2011 |
| EP | 2 340 730 | A1 | 7/2011 |
| EP | 2 394 520 | | 12/2011 |
| EP | 2 757 911 | A1 | 7/2014 |
| GB | 793114 | A | 4/1958 |
| GB | 866803 | A | 5/1961 |
| GB | 988811 | A | 4/1965 |
| GB | 994169 | A | 6/1965 |
| GB | 1124434 | A | 8/1968 |
| GB | 1151634 | A | 5/1969 |
| GB | 88318 | C2 | 10/2009 |
| GB | 2473264 | | 3/2011 |
| JP | 50-105896 | A | 8/1975 |
| JP | 51-12999 | | 1/1976 |
| JP | 52-10500 | | 1/1977 |
| JP | 64-71470 | | 3/1989 |
| JP | 1-243979 | A | 9/1989 |
| JP | 2-53476 | A | 2/1990 |
| JP | 05-103836 | A | 4/1993 |
| JP | 5-211861 | A | 8/1993 |
| JP | 9-103280 | | 4/1997 |
| JP | 9-107942 | A | 4/1997 |
| JP | 9-316420 | A | 12/1997 |
| JP | 11-103839 | A | 4/1999 |
| JP | 2006-504431 | | 2/2006 |
| JP | 2008-525009 | | 7/2008 |
| JP | 2009-502194 | A | 1/2009 |
| JP | 2009-529871 | | 8/2009 |
| JP | 2010-506594 | | 3/2010 |
| JP | 2010-520742 | | 6/2010 |
| JP | 2010-520764 | A | 6/2010 |
| JP | 2010-178730 | A | 8/2010 |
| JP | 2010-535530 | | 11/2010 |
| JP | 2011-509667 | A | 3/2011 |
| JP | 2011-512853 | A | 4/2011 |
| JP | 2011-115141 | A | 6/2011 |
| JP | 2015-517817 | A | 6/2015 |
| JP | 2015-523857 | A | 8/2015 |
| KR | 10-1993-0000048 | A | 1/1993 |
| KR | 0178388 | B1 | 2/1999 |
| KR | 10-2001-0013020 | | 2/2001 |
| KR | 10-2004-0084899 | | 10/2004 |
| KR | 10-2009-0046820 | | 5/2009 |
| KR | 10-2010-0054141 | | 5/2010 |
| KR | 10-2010-0121539 | A | 11/2010 |
| KZ | 11053 | | 12/2001 |
| RU | 2 214 141 | C2 | 10/2003 |
| RU | 2 346 629 | C2 | 2/2009 |
| RU | 2 356 458 | C2 | 5/2009 |
| RU | 2008 131 960 | A | 2/2010 |
| RU | 2 410 993 | C2 | 2/2011 |
| TW | 209162 | | 7/1993 |
| TW | 200934399 | A | 8/2009 |
| TW | 200942185 | A1 | 10/2009 |
| TW | 201012400 | A1 | 4/2010 |
| TW | 201043157 | A1 | 12/2010 |
| WO | 94/06314 A 1 | | 3/1994 |
| WO | 95/10950 | A2 | 4/1995 |
| WO | 96/32854 | A2 | 10/1996 |
| WO | 2004/041007 | A2 | 5/2004 |
| WO | 2005/032285 A 1 | | 4/2005 |
| WO | 2007/108877 | A2 | 9/2007 |
| WO | 2008/015570 | A2 | 2/2008 |
| WO | WO 2008/015441 | A1 | 2/2008 |
| WO | WO 2009/021018 | A1 | 2/2009 |
| WO | WO 2009/022232 | | 2/2009 |
| WO | WO 2009/143338 | A2 | 11/2009 |
| WO | WO 2010/028354 | A1 | 3/2010 |
| WO | WO 2010/047389 | A1 | 4/2010 |
| WO | WO 2010/113702 | A1 | 10/2010 |
| WO | WO 2011/045066 | A1 | 4/2011 |
| WO | WO 2011/068020 | A1 | 6/2011 |
| WO | WO 2011/077138 | A1 | 6/2011 |
| WO | WO 2011/101164 | A1 | 8/2011 |
| WO | WO 2011/141735 | A1 | 11/2011 |
| WO | WO 2012/012053 | A1 | 1/2012 |
| WO | WO 2012/014490 | A1 | 2/2012 |
| WO | WO 2012/164009 | A2 | 12/2012 |
| WO | WO 2013/076098 | A2 | 5/2013 |
| WO | WO 2013/098353 | A1 | 7/2013 |
| WO | WO 2013/098405 | A2 | 7/2013 |
| WO | WO 2013/098410 | A2 | 7/2013 |

OTHER PUBLICATIONS

International Preliminary Report on Patentability (IPRP) issued in PCT/EP2012/077086 dated Aug. 13, 2014 (14 pages).

International Search Report dated Jan. 24, 2014, in PCT/EP12/077086, filed Dec. 28, 2012.

Written Opinion of the International Searching Authority dated Jun. 23, 2014, in PCT/EP12/077086, filed Dec. 28, 2012.

International Preliminary Report on Patentability dated Aug. 14, 2014 in PCT/EP2012/077086.

Office Action dated Mar. 10, 2016 in Chinese Patent Application No. 201280072200.7 (English-language Translation only).

Notice of Allowance dated Apr. 7, 2016 in Korean Patent Application No. 10-2014-7024000 (English-language Translation only).

Taiwanese Search Report with English translation dated Jul. 10, 2017 in the corresponding Taiwanese Patent Application No. 101151338, citing documents AO and AP therein (10 pages).

Office Action dated Nov. 13, 2019 in Chinese Application No. 201711346822.5, along with an English translation, citing reference AO above.

Combined Chinese Office Action and Search Report dated Dec. 11, 2019, in Patent Application No. 201711347424.5, citing documents AO-AP therein, 21 pages (with English translation).

Chinese Office Action issued Feb. 23, 2021 in corresponding Chinese Patent Application No. 201810597257.8 (with English translation), 13 pages.

Zhang Huailing, et al., "Blended Type Cigarettes, First Edition", China Light Industry Press, Nov. 30, 1997, 6 pages.

Jones, S. 0., "Evaluation of Filter Plugs Prepared From 21-Pound Foil Backing Paper Using the RJR Corrugating Machine" RJ Reynolds, RDM, 1958; No. 70, https://www.industrydocuments.ucsf.edu/tobacco/docs/#id=rzxn0096 (Year: 1958).

Combined Chinese Office Action and Search Report dated Apr. 1, 2021 in corresponding Chinese Patent Application No. 201910426523.5 (with English translation), 21 pages.

"Determination of the Draw Resistance of Cigarettes and Filter Rods", Coresta Recommended Method N° 41, Jun. 2007, pp. 1-19.

Special Filter Rod-Part 1: Acetate Fiber Flute Filter Rod China Tobacco Industry Standard YC/T 223-1-2007, Jul. 5, 2007, 11 pages.

(56) References Cited

OTHER PUBLICATIONS

Combined Office Action and Search Report dated Dec. 14, 2015 in Chinese Patent Application No. 201280061532.5 (English translation only).
Combined Office Action and Search Report dated Jan. 14, 2016 in Chinese Patent Application No. 201280061528.9 (with English translation only).
Combined Office Action and Search Report dated Jun. 3, 2016 in Chinese Patent Application No. 201380034575.9 (submitting English translation only).
Combined Chinese Office Action and Search Report dated Jun. 20, 2016 in Patent Application No. 201380034799.X (submitting English translation only).
Combined Chinese Office Action and Search Report dated Jun. 27, 2016 in Patent Application No. 201380034602.2 (submitting English translation only).
Combined Office Action and Search Report dated Jul. 5, 2016 in Chinese Patent Application No. 201380031712.3 (submitting English translation only).
Combined Chinese Office Action and Search Report dated Aug. 2, 2016 in Patent Application No. 201380044053.7 (submitting English translation only).
English translation only of Chinese Office Action dated Nov. 25, 2016 in corresponding Chinese Application No. 201280061528.9. (4 pages).
Combined Search Report and Office Action dated Jan. 4, 2017 in Chinese Patent Application No. 201380031712.3 (English translation only), 7 pages.
Combined Office Action and Search Report dated Feb. 20, 2017 in Chinese Patent Application No. 201380034602.2 (English translation only).
Chinese Office Action dated Mar. 8, 2017(English translation only) received in corresponding Chinese Application No. 201280064910.5, (7 pages).
Chinese Office Action received in the corresponding Chinese application No. 201280061528.9 (Date of Notification: May 3, 2017).
Chinese Office Action dated Feb. 13, 2018 in Patent Application No. 201380044053.7 (with English translation), 254 pages.
Chinese Office Action dated Jul. 17, 2020 in corresponding Chinese Application No. 201711347424.5 (with English translation).
Extended Search Report dated Oct. 29, 2012 in European patent Application No. 12170358.1.
Extended Search Report dated Oct. 30, 2012, in European Patent Application No. 12170359.9.
Extended European Search Report dated Nov. 5, 2012 in European Patent Application No. 12173054.3.
Extended Search Report dated Nov. 27, 2012 in European Patent Application No. 12170360.7.
Extended Search Report dated Mar. 19, 2013 in 12170356.5.
Extended European Search Report dated Dec. 20, 2019 in European Application No. 19189686.9 (8 pages).
Partial Search Report dated Nov. 30, 2012 in European Patent Application No. 12170356.5.
Office Action dated Sep. 11, 2017 in European Patent Application No. 12 821 115.8, (5 pages).
Office Action dated Dec. 11, 2017 in Europe Patent Application No. 13 726 206.9, (5 pages).
International Search Report dated Jun. 11, 2013 in PCT/EP12/077091 filed Dec. 28, 2012.
International Search Report dated Jul. 5, 2013 in PCT/EP12/077077 filed Dec. 28, 2012.
International Search Report dated Sep. 30, 2013 in PCT/EP13/061209 Filed May 30, 2013.
International Search Report and Written Opinion dated Sep. 30, 2013 in PCT/EP2013/061210 filed May 30, 2013.
International Search Report dated Oct. 2, 2013, in PCT/2013/061208 Filed May 30, 2013.
International Search Report and Written Opinion dated Oct. 7, 2013 in PCT/EP2013/061211 filed May 30, 2013.
International Search Report dated Oct. 8, 2013, in PCT/EP12/077087 filed Dec. 28, 2012.
International Search Report dated Nov. 26, 2013 in PCT/EP2013/062869.
International Search Report dated Feb. 6, 2014 in PCT/EP2012/077092 filed Dec. 28, 2012.
Written Opinion of the International Searching Authority dated Jun. 11, 2013 in PCT/EP12/077091 filed Dec. 28, 2012.
Written Opinion of the International Searching Authority dated Jul. 5, 2013 in PCT/EP12/077077 filed Dec. 28, 2012.
Written Opinion of the International Searching Authority dated Sep. 30, 2013 in PCT/EP13/061209 Filed May 30, 2013.
Written Opinion dated Oct. 2, 2013 in PCT/EP2013/061208 filed May 30, 2013.
Written Opinion of the International Searching Authority dated Oct. 8, 2013, in PCT/EP12/077087 filed Dec. 28, 2012.
Written Opinion of the International Searching Authority dated Feb. 6, 2014 in PCT/EP2012/077092 filed Dec. 28, 2012.
International Preliminary Report on Patentability (IPRP) issued in PCT/EP2012/077087 dated Oct. 29, 2014 (15 pages).
International Preliminary Report on Patentability dated Nov. 13, 2014 in PCT/EP2013/062869 filed Jun. 20, 2013.
International Preliminary Report on Patentability dated Dec. 2, 2014 in PCT/EP2013/061209 filed May 30, 2013.
International Preliminary Report on Patentability dated Dec. 2, 2014 in PCT/EP2013/061210 filed on May 30, 2013.
International Preliminary Report on Patentability dated Dec. 2, 2014 in PCT/EP2013/061211 filed May 30, 2013.
International Preliminary Report on Patentability dated Dec. 11, 2014 in PCT/EP2013/061208 filed May 30, 2013.
Israeli Office Action with English translation dated Mar. 13, 2019 in corresponding Israeli Patent Application No. 235629, (7 pages).
Office Action dated Mar. 22, 2016 in Japanese Patent Application No. 2015-517760 (submitting English translation only).
English translation only of Japanese Office Action dated Oct. 17, 2016 in Japanese Patent Application No. JP 2014-549499 (3 pages).
Office Action dated Mar. 29, 2017 in Japanese Patent Application No. 2015-514514 (with unedited computer generated English translation).
Office Action dated Mar. 29, 2017 in Japanese Patent Application No. 2015-514513 (with unedited computer generated English translation).
Office Action dated Mar. 29, 2017 in Japanese Patent Application No. 2015-514511 (with unedited computer generated English translation).
English language translation only of Japanese Office Action dated Apr. 17, 2017 in corresponding Japanese Patent Application No. 2015-514512, 5 pages.
Office Action dated Dec. 6, 2017 in Japanese Patent Application No. 2015-514511 (with English language translation), 8 pages.
Japanese Pre-Appeal Review report with English translation dated Feb. 27, 2018 in corresponding Japanese Patent Application No. 2015-514514 (4 pages).
Office Action dated Feb. 28, 2018 in Japanese Patent Application No. 2015-514512 (with English language translation).
Japanese Office Action with English translation dated Dec. 17, 2018 in corresponding Japanese Patent Application No. 2017-250915.
Japanese Office Action with English translation dated Aug. 30, 2019 in corresponding Japanese Patent Application No. 2018-122637, (8 pages).
Office Action dated Dec. 8, 2015 in Kazakhstani Patent Application No. 2014/1655.1 (English translation only).
Office Action dated Aug. 23, 2016 in Kazak Patent Application No. 2014/2552.1 (submitting English translation only).
Office Action dated Mar. 21, 2015 in Korean Patent Application No. 10-2014-7012121 (with English translation only).
Korean Search Report dated Dec. 16, 2015 in Patent Application No. 10-2014-7036378.
Korean Office Action dated Apr. 8, 2016 in Patent Application No. 10-2014-7036378 (English translation only).
Korean Notice of Allowance dated Oct. 31, 2019 in Korean Patent Application No. 10-2014-7012246, 2 pages.

(56) References Cited

OTHER PUBLICATIONS

Korean Notice of Allowance dated Jun. 24, 2020 in corresponding Korean Application No. 10-2014-7033532 (with English translation), 3 pages.
Korean Notice of Allowance dated Jun. 25, 2020 in corresponding Korean Application No. 10-2014-7034539 (with English translation, 3 pages.
New Zealand Office Action dated Nov. 10, 2015 in Patent Application No. 703078, (3 pages).
Office Action dated Jul. 29, 2016 in Russian Patent Application No. 2015101642/12(002456) (submitting English translation only).
English translation only of Decision to Grant dated Apr. 24, 2017 and received in corresponding Russian Application No. 2014153579/12(085605), (4 pages).
Russian Office Action dated Jun. 8, 2017 in Patent Application No. 2014153639 (with English Translation), 11 pages.
Russian Office Action dated Jun. 23, 2017 in Patent Application No. 2014153008 (with English Translation), 11 pages.
Combined Office Action and Search Report dated Apr. 19, 2017 in Taiwanese Patent Application No. 102121900 (submitting English translation only), 4 pages.
Chinese Office Action dated Jul. 10, 2020 in corresponding Chinese Application No. 201810597257.8 (with English translation), 19 pages.
China Tobacco Yearbook: 1998-1999 (vol. 2) (compiled by the State Tobacco Monopoly Administration, Beijing: The Economic Daily Press; Dec. 2000, pp. 573-574).

* cited by examiner

AEROSOL-GENERATING ARTICLE HAVING AN AEROSOL-COOLING ELEMENT

CROSS REFERENCE TO RELATED APPLICATION

This application is a national phase application based on PCT/EP2012/077086, filed on Dec. 28, 2012.

The present specification relates to an aerosol-generating article comprising an aerosol-forming substrate and an aerosol-cooling element for cooling an aerosol formed from the substrate.

Aerosol-generating articles in which an aerosol-forming substrate, such as a tobacco containing substrate, is heated rather than combusted are known in the art. Examples of systems using aerosol-generating articles include systems that heat a tobacco containing substrate above 200 degrees Celsius to produce a nicotine containing aerosol. Such systems may use a chemical or gas heater, such as the system sold under the commercial name Ploom.

The aim of such systems using heated aerosol-generating articles is to reduce known harmful smoke constituents produced by the combustion and pyrolytic degradation of tobacco in conventional cigarettes. Typically in such heated aerosol-generating articles, an inhalable aerosol is generated by the transfer of heat from a heat source to a physically separate aerosol-forming substrate or material, which may be located within, around or downstream of the heat source. During consumption of the aerosol-generating article, volatile compounds are released from the aerosol-forming substrate by heat transfer from the heat source and entrained in air drawn through the aerosol-generating article. As the released compounds cool, they condense to form an aerosol that is inhaled by the consumer.

Conventional cigarettes combust tobacco and generate temperatures that release volatile compounds. Temperatures in the burning tobacco can reach above 800 degrees Celsius and such high temperatures drive off much of the water contained in the smoke evolved from the tobacco. Mainstream smoke produced by conventional cigarettes tends to be perceived by a smoker as having a low temperature because it is relatively dry. An aerosol generated by the heating of an aerosol-forming substrate without burning may have higher water content due to the lower temperatures to which the substrate is heated. Despite the lower temperature of aerosol formation, the aerosol stream generated by such systems may have a higher perceived temperature than conventional cigarette smoke.

EP0532329 discloses cigarettes including a filter element which have a gathered web of paper incorporating a carbon material. The filter segment has a plurality of longitudinally extending channels of a cross-sectional area such that particulate phase components of mainstream smoke passing through the filter segment are not filtered by or do not interact to a significant degree with the carbon material, whilst significant amounts of gas phase components of the mainstream smoke can be removed by the carbon material.

U.S. Pat. No. 3,122,145 discloses use of a bulrush stem segment as a filter in a cigarette. It is disclosed that the section of bulrush stem may, when impregnated with water or when impregnated with water and frozen, act to cool mainstream smoke passing through the filter.

The specification relates to an aerosol-generating article and a method of using an aerosol-generating article.

In one embodiment an aerosol-generating article comprising a plurality of elements assembled in the form of a rod is provided. The plurality of elements include an aerosol-forming substrate and an aerosol-cooling element located downstream from the aerosol-forming substrate within the rod. The aerosol-cooling element comprises a plurality of longitudinally extending channels and has a porosity of between 50% and 90% in the longitudinal direction. The aerosol-cooling element may alternatively be referred to as a heat exchanger based on its functionality, as described further herein.

As used herein, the term aerosol-generating article is used to denote an article comprising an aerosol-forming substrate that is capable of releasing volatile compounds that can form an aerosol. An aerosol-generating article may be a non-combustible aerosol-generating article, which is an article that releases volatile compounds without the combustion of the aerosol-forming substrate. An aerosol-generating article may be a heated aerosol-generating article, which is an aerosol-generating article comprising an aerosol-forming substrate that is intended to be heated rather than combusted in order to release volatile compounds that can form an aerosol. A heated aerosol-generating article may comprise an on-board heating means forming part of the aerosol-generating article, or may be configured to interact with an external heater forming part of a separate aerosol-generating device An aerosol-generating article may be a smoking article that generates an aerosol that is directly inhalable into a user's lungs through the user's mouth. An aerosol-generating article may resemble a conventional smoking article, such as a cigarette and may comprise tobacco. An aerosol-generating article may be disposable. An aerosol-generating article may alternatively be partially-reusable and comprise a replenishable or replaceable aerosol-forming substrate.

As used herein, the term 'aerosol-forming substrate' relates to a substrate capable of releasing volatile compounds that can form an aerosol. Such volatile compounds may be released by heating the aerosol-forming substrate. An aerosol-forming substrate may be adsorbed, coated, impregnated or otherwise loaded onto a carrier or support. An aerosol-forming substrate may conveniently be part of an aerosol-generating article or smoking article.

An aerosol-forming substrate may comprise nicotine. An aerosol-forming substrate may comprise tobacco, for example may comprise a tobacco-containing material containing volatile tobacco flavour compounds, which are released from the aerosol-forming substrate upon heating. In preferred embodiments an aerosol-forming substrate may comprise homogenised tobacco material, for example cast leaf tobacco.

As used herein, an 'aerosol-generating device' relates to a device that interacts with an aerosol-forming substrate to generate an aerosol. The aerosol-forming substrate forms part of an aerosol-generating article, for example part of a smoking article. An aerosol-generating device may comprise one or more components used to supply energy from a power supply to an aerosol-forming substrate to generate an aerosol.

An aerosol-generating device may be described as a heated aerosol-generating device, which is an aerosol-generating device comprising a heater. The heater is preferably used to heat an aerosol-forming substrate of an aerosol-generating article to generate an aerosol.

An aerosol-generating device may be an electrically heated aerosol-generating device, which is an aerosol-generating device comprising a heater that is operated by electrical power to heat an aerosol-forming substrate of an aerosol-generating article to generate an aerosol. An aerosol-generating device may be a gas-heated aerosol-generating device. An aerosol-generating device may be a smoking device that interacts with an aerosol-forming substrate of an aerosol-generating article to generate an aerosol that is directly inhalable into a user's lungs thorough the user's mouth.

As used herein, 'aerosol-cooling element' refers to a component of an aerosol-generating article located downstream of the aerosol-forming substrate such that, in use, an aerosol formed by volatile compounds released from the aerosol-forming substrate passes through and is cooled by the aerosol cooling element before being inhaled by a user. Preferably, the aerosol-cooling element is positioned between the aerosol-forming substrate and the mouthpiece. An aerosol cooling element has a large surface area, but causes a low pressure drop. Filters and other mouthpieces that produce a high pressure drop, for example filters formed from bundles of fibres, are not considered to be aerosol-cooling elements. Chambers and cavities within an aerosol-generating article are not considered to be aerosol cooling elements.

As used herein, the term 'rod' is used to denote a generally cylindrical element of substantially circular, oval or elliptical cross-section.

The plurality of longitudinally extending channels may be defined by a sheet material that has been crimped, pleated, gathered or folded to form the channels. The plurality of longitudinally extending channels may be defined by a single sheet that has been pleated, gathered or folded to form multiple channels. The sheet may also have been crimped. Alternatively, the plurality of longitudinally extending channels may be defined by multiple sheets that have been crimped, pleated, gathered or folded to form multiple channels.

As used herein, the term 'sheet' denotes a laminar element having a width and length substantially greater than the thickness thereof.

As used herein, the term 'longitudinal direction' refers to a direction extending along, or parallel to, the cylindrical axis of a rod.

As used herein, the term 'crimped' denotes a sheet having a plurality of substantially parallel ridges or corrugations. Preferably, when the aerosol-generating article has been assembled, the substantially parallel ridges or corrugations extend in a longitudinal direction with respect to the rod.

As used herein, the terms 'gathered', 'pleated', or 'folded' denote that a sheet of material is convoluted, folded, or otherwise compressed or constricted substantially transversely to the cylindrical axis of the rod. A sheet may be crimped prior to being gathered, pleated or folded. A sheet may be gathered, pleated or folded without prior crimping.

The aerosol-cooling element may have a total surface area of between 300 $mm^2$ per mm length and 1000 $mm^2$ per mm length. The aerosol-cooling element may be alternatively termed a heat exchanger.

The aerosol-cooling element preferably offers a low resistance to the passage of air through the rod. Preferably, the aerosol-cooling element does not substantially affect the resistance to draw of the aerosol-generating article. Resistance to draw (RTD) is the pressure required to force air through the full length of the object under test at the rate of 17.5 ml/sec at 22° C. and 101 kPa (760 Torr). RTD is typically expressed in units of $mmH_2O$ and is measured in accordance with ISO 6565:2011. Thus, it is preferred that there is a low-pressure drop from an upstream end of the aerosol-cooling element to a downstream end of the aerosol-cooling element. To achieve this, it is preferred that the porosity in a longitudinal direction is greater than 50% and that the airflow path through the aerosol-cooling element is relatively uninhibited. The longitudinal porosity of the aerosol-cooling element may be defined by a ratio of the cross-sectional area of material forming the aerosol-cooling element and an internal cross-sectional area of the aerosol-generating article at the portion containing the aerosol-cooling element.

The terms "upstream" and "downstream" may be used to describe relative positions of elements or components of the aerosol-generating article. For simplicity, the terms "upstream" and "downstream" as used herein refer to a relative position along the rod of the aerosol-generating article with reference to the direction in which the aerosol is drawn through the rod.

It is preferred that airflow through the aerosol-cooling element does not deviate to a substantive extent between adjacent channels. In other words, it is preferred that the airflow through the aerosol-cooling element is in a longitudinal direction along a longitudinal channel, without substantive radial deviation. In some embodiments, the aerosol-cooling element is formed from a material that has a low porosity, or substantially no-porosity other than the longitudinally extending channels. That is, the material used to define or form the longitudinally extending channels, for example a crimped and gathered sheet, has low porosity or substantially no porosity.

In some embodiments, the aerosol-cooling element may comprise a sheet material selected from the group comprising a metallic foil, a polymeric sheet, and a substantially non-porous paper or cardboard. In some embodiments, the aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil.

After consumption, aerosol-generating articles are typically disposed of. It may be advantageous for the elements forming the aerosol-generating article to be biodegradable. Thus, it may be advantageous for the aerosol-cooling element to be formed from a biodegradable material, for example a non-porous paper or a biodegradable polymer such as polylactic acid or a grade of Mater-Bi® (a commercially available family of starch based copolyesters). In some embodiments, the entire aerosol-generating article is biodegradable or compostable.

It is desirable that the aerosol-cooling element has a high total surface area. Thus, in preferred embodiments the aerosol-cooling element is formed by a sheet of a thin material that has been crimped and then pleated, gathered, or folded to form the channels. The more folds or pleats within a given volume of the element then the higher the total surface area of the aerosol-cooling element. In some embodiments, the aerosol-cooling element may be formed from a material having a thickness of between about 5 micrometres and about 500 micrometres, for example between about 10 micrometres and about 250 micrometers. In some embodiments, the aerosol-cooling element has a total surface area of between about 300 square millimetres per millimetre of length ($mm^2$/mm) and about 1000 square millimetres per millimetre of length ($mm^2$/mm). In other words, for every millimetre of length in the longitudinal direction the aerosol-cooling element has between about 300 square millimetres and about 1000 square millimetres of surface area. Preferably, the total surface area is about 500 $mm^2$/mm per mm.

The aerosol-cooling element may be formed from a material that has a specific surface area of between about 10 square millimetres per milligram ($mm^2/mg$) and about 100 square millimetres per milligram ($mm^2/mg$). In some embodiments, the specific surface area may be about 35 $mm^2/mg$.

Specific surface area can be determined by taking a material having a known width and thickness. For example, the material may be a PLA material having an average thickness of 50 micrometers with a variation of ±2 micrometers. Where the material also has a known width, for example, between about 200 millimetres and about 250 millimetres, the specific surface area and density can be calculated.

When an aerosol that contains a proportion of water vapour is drawn through the aerosol-cooling element, some of the water vapour may condense on surfaces of the longitudinally extending channels defined through the aerosol-cooling element. If water condenses, it is preferred that droplets of the condensed water are maintained in droplet form on a surface of the aerosol-cooling element rather than being absorbed into the material forming the aerosol-cooling element. Thus, it is preferred that the material forming the aerosol-cooling element is substantially non-porous or substantially non-absorbent to water.

The aerosol-cooling element may act to cool the temperature of a stream of aerosol drawn through the element by means of thermal transfer. Components of the aerosol will interact with the aerosol-cooling element and loose thermal energy.

The aerosol-cooling element may act to cool the temperature of a stream of aerosol drawn through the element by undergoing a phase transformation that consumes heat energy from the aerosol stream. For example, the material forming the aerosol-cooling element may undergo a phase transformation such as melting or a glass transition that requires the absorption of heat energy. If the element is selected such that it undergoes such an endothermic reaction at the temperature at which the aerosol enters the aerosol-cooling element, then the reaction will consume heat energy from the aerosol stream.

The aerosol-cooling element may act to lower the perceived temperature of a stream of aerosol drawn through the element by causing condensation of components such as water vapour from the aerosol stream. Due to condensation, the aerosol stream may be drier after passing through the aerosol-cooling element. In some embodiments, the water vapour content of an aerosol stream drawn through the aerosol-cooling element may be lowered by between about 20% and about 90%. The user may perceive the temperature of this aerosol to be lower than a moister aerosol of the same actual temperature. Thus, the feeling of the aerosol in a user's mouth may be closer to the feeling provided by the smoke stream of a conventional cigarette.

In some embodiments, the temperature of an aerosol stream may be lowered by more than 10 degrees Celsius as it is drawn through an aerosol-cooling element. In some embodiments, the temperature of an aerosol stream may be lowered by more than 15 degrees Celsius or more than 20 degrees Celsius as it is drawn through an aerosol-cooling element.

In some embodiments, the aerosol-cooling element removes a proportion of the water vapour content of an aerosol drawn through the element. In some embodiments, a proportion of other volatile substances may be removed from the aerosol stream as the aerosol is drawn through the aerosol-cooling element. For example, in some embodiments a proportion of phenolic compounds may be removed from the aerosol stream as the aerosol is drawn through the aerosol-cooling element.

Phenolic compounds may be removed by interaction with the material forming the aerosol-cooling element. For example, the phenolic compounds (for example phenols and cresols) may be adsorbed by the material that the aerosol-cooling element is formed from.

Phenolic compounds may be removed by interaction with water droplets condensed within the aerosol-cooling element.

Preferably, more than 50% of mainstream phenol yields are removed. In some embodiments, more than 60% of mainstream phenol yields are removed. In some embodiments, more than 75%, or more than 80% or more than 90% of mainstream phenol yields are removed.

As noted above, the aerosol-cooling element may be formed from a sheet of suitable material that has been crimped, pleated, gathered or folded into an element that defines a plurality of longitudinally extending channels. A cross-sectional profile of such an aerosol-cooling element may show the channels as being randomly oriented. The aerosol-cooling element may be formed by other means. For example, the aerosol-cooling element may be formed from a bundle of longitudinally extending tubes. The aerosol-cooling element may be formed by extrusion, molding, lamination, injection, or shredding of a suitable material.

The aerosol-cooling element may comprise an outer tube or wrapper that contains or locates the longitudinally extending channels. For example, a pleated, gathered, or folded sheet material may be wrapped in a wrapper material, for example a plug wrapper, to form the aerosol-cooling element. In some embodiments, the aerosol-cooling element comprises a sheet of crimped material that is gathered into a rod-shape and bound by a wrapper, for example a wrapper of filter paper.

In some embodiments, the aerosol-cooling element is formed in the shape of a rod having a length of between about 7 millimetres (mm) and about 28 millimetres (mm). For example, an aerosol-cooling element may have a length of about 18 mm. In some embodiments, the aerosol-cooling element may have a substantially circular cross-section and a diameter of about 5 mm to about 10 mm. For example, an aerosol-cooling element may have a diameter of about 7 mm.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper is considered to be the aerosol-forming substrate.

Optionally, the solid aerosol-forming substrate may contain additional tobacco or non-tobacco volatile flavour compounds, to be released upon heating of the solid aerosol-forming substrate. The solid aerosol-forming substrate may also contain capsules that, for example, include the additional tobacco or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, spaghettis, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The elements of the aerosol-generating article are preferably assembled by means of a suitable wrapper, for example a cigarette paper. A cigarette paper may be any suitable material for wrapping components of an aerosol-generating article in the form of a rod. The cigarette paper needs to grip the component elements of the aerosol-generating article when the article is assembled and hold them in position within the rod. Suitable materials are well known in the art.

It may be particularly advantageous for an aerosol-cooling element to be a component part of a heated aerosol-generating article having an aerosol-forming substrate formed from or comprising a homogenised tobacco material having an aerosol former content of greater than 5% on a dry weight basis and water. For example the homogenised tobacco material may have an aerosol former content of between 5% and 30% by weight on a dry weight basis. An aerosol generated from such aerosol-forming substrates may be perceived by a user to have a particularly high temperature and the use of a high surface area, low RTD aerosol-cooling element may reduce the perceived temperature of the aerosol to an acceptable level for the user.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be received in the aerosol-generating device such that the length of the aerosol-forming substrate is substantially parallel to the airflow direction in the aerosol-generating device. The aerosol-cooling element may be substantially elongate.

The aerosol-generating article may have a total length between approximately 30 mm and approximately 100 mm. The aerosol-generating article may have an external diameter between approximately 5 mm and approximately 12 mm.

The aerosol-generating article may comprise a filter or mouthpiece. The filter may be located at the downstream end of the aerosol-generating article. The filter may be a cellulose acetate filter plug. The filter is approximately 7 mm in length in one embodiment, but may have a length of between approximately 5 mm and approximately 10 mm. The aerosol-generating article may comprise a spacer element located downstream of the aerosol-forming substrate.

In one embodiment, the aerosol-generating article has a total length of approximately 45 mm. The aerosol-generating article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm.

In one embodiment, a method of assembling an aerosol-generating article comprising a plurality of elements assembled in the form of a rod is provided. The plurality of elements include an aerosol-forming substrate and an aerosol-cooling element located downstream of the aerosol-forming substrate within the rod.

In some embodiments, the cresol content of the aerosol is reduced as it is drawn through the aerosol-cooling element.

In some embodiments, the phenol content of the aerosol is reduced as it is drawn through the aerosol-cooling element.

In some embodiments, the water content of the aerosol is reduced as it is drawn through the aerosol-cooling element.

In one embodiment, a method of using a aerosol-generating article comprising a plurality of elements assembled in the form of a rod is provided. The plurality of elements include an aerosol-forming substrate and an aerosol-cooling element located downstream of the aerosol-forming substrate within the rod. The method comprises the steps of heating the aerosol-forming substrate to evolve an aerosol and inhaling the aerosol. The aerosol is inhaled through the aerosol-cooling element and is reduced in temperature prior to being inhaled.

Features described in relation to one embodiment may also be applicable to other embodiments.

A specific embodiment will now be described with reference to the figures, in which;

FIG. 1 illustrates an aerosol-generating article 10 according to an embodiment. The aerosol-generating article 10 comprises four elements, an aerosol-forming substrate 20, a hollow cellulose acetate tube 30, an aerosol-cooling element 40, and a mouthpiece filter 50. These four elements are arranged sequentially and in coaxial alignment and are assembled by a cigarette paper 60 to form a rod 11. The rod 11 has a mouth-end 12, which a user inserts into his or her mouth during use, and a distal end 13 located at the opposite end of the rod 11 to the mouth end 12. Elements located between the mouth-end 12 and the distal end 13 can be described as being upstream of the mouth-end 12 or, alternatively, downstream of the distal end 13.

Figure 1:
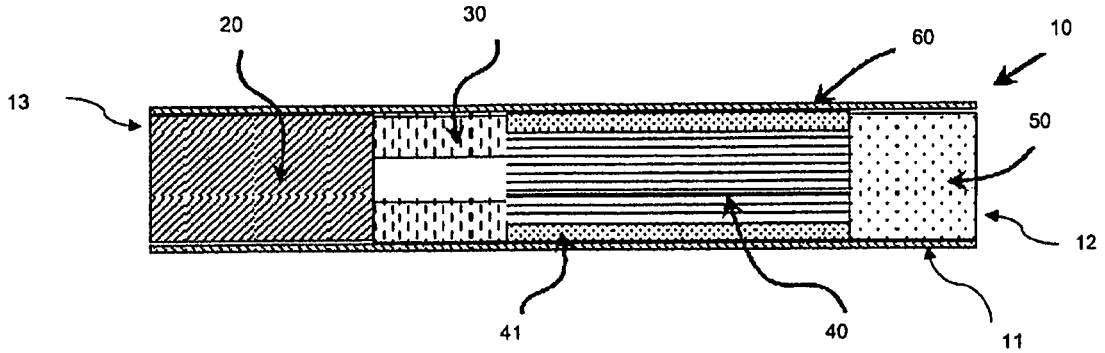
FIG. 1 is a schematic cross-sectional diagram of a first embodiment of an aerosol-generating article.

When assembled, the rod 11 is about 45 millimetres in length and has an outer diameter of about 7.2 millimetres and an inner diameter of about 6.9 millimetres.

The aerosol-forming substrate 20 is located upstream of the hollow tube 30 and extends to the distal end 13 of the rod 11. In one embodiment, the aerosol-forming substrate 20 comprises a bundle of crimped cast-leaf tobacco wrapped in a filter paper (not shown) to form a plug. The cast-leaf tobacco includes additives, including glycerine as an aerosol-forming additive.

The hollow acetate tube 30 is located immediately downstream of the aerosol-forming substrate 20 and is formed from cellulose acetate. One function of the tube 30 is to locate the aerosol-forming substrate 20 towards the distal end 13 of the rod 11 so that it can be contacted with a heating element. The tube 30 acts to prevent the aerosol-forming substrate 20 from being forced along the rod 11 towards the aerosol-cooling element 40 when a heating element is inserted into the aerosol-forming substrate 20. The tube 30 also acts as a spacer element to space the aerosol-cooling element 40 from the aerosol-forming substrate 20.

The aerosol-cooling element 40 has a length of about 18 mm, an outer diameter of about 7.12 mm, and an inner diameter of about 6.9 mm. In one embodiment, the aerosol-cooling element 40 is formed from a sheet of polylactic acid having a thickness of 50 mm±2 mm. The sheet of polylactic acid has been crimped and gathered to define a plurality of channels that extend along the length of the aerosol-cooling element 40. The total surface area of the aerosol-cooling element is between 8000 $mm^2$ and 9000 $mm^2$, which is equivalent to approximately 500 $mm^2$ per mm length of the aerosol-cooling element 40. The specific surface area of the aerosol-cooling element 40 is approximately 2.5 $mm^2/mg$ and it has a porosity of between 60% and 90% in the longitudinal direction. The polylactic acid is kept at a temperature of 160 degrees Celsius or less during use.

Porosity is defined herein as a measure of unfilled space in a rod including an aerosol-cooling element consistent with the one discussed herein. For example, if a diameter of the rod 11 was 50% unfilled by the element 40, the porosity would be 50%. Likewise, a rod would have a porosity of 100% if the inner diameter was completely unfilled and a porosity of 0% if completely filled. The porosity may be calculated using known methods.

Figure 11A:
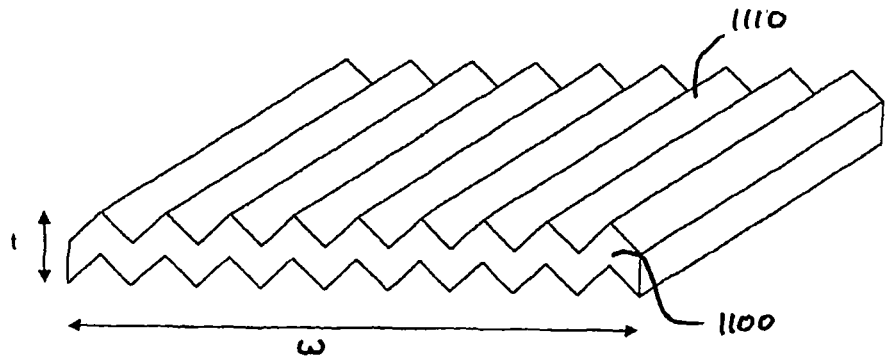
FIGS. 11A, 11B and 11C illustrate dimensions of a crimped sheet material and a rod that may be used to calculate the longitudinal porosity of the aerosol-cooling element.
Figure 11B:
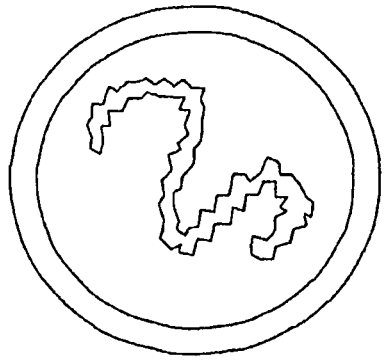
Figure 11C:
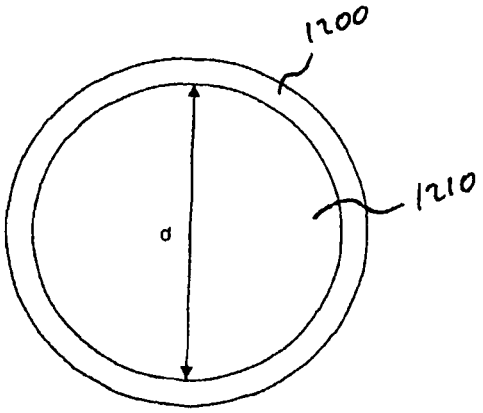

An exemplary illustration of how porosity is calculated is provided here and illustrated in FIGS. 11A, 11B, and 11C. When the aerosol-cooling element 40 is formed from a sheet of material 1110 having a thickness (t) and a width (w) the cross-sectional area presented by an edge 1100 of the sheet material 1110 is given by the width multiplied by the thickness. In a specific embodiment of a sheet material having a thickness of 50 micrometers (±2 micrometers) and width of 230 millimetres, the cross-sectional area is approximately $1.15\times10^{-5}$ $m^2$ (this may be denoted the first area). An exemplary crimped material is illustrated in FIG. 11 with the thickness and width labelled. An exemplary rod 1200 is also illustrated having a diameter (d). The inner area 1210 of the rod is given by the formula $(d/2)^2\pi$. Assuming an inner diameter of the rod that will eventually enclose the material is 6.9 mm, the area of unfilled space may be calculated as approximately $3.74\times10^{-5}$ $m^2$ (this may be denoted the second area).

The crimped or uncrimped material comprising the aerosol-cooling element 40 is then gathered or folded and confined within the inner diameter of the rod (FIG. 11B). The ratio of the first and second area based on the above examples is approximately 0.308. This ratio is multiplied by 100 and the quotient is subtracted from 100% to arrive at the porosity, which is approximately 69% for the specific figures given here. Clearly, the thickness and width of a sheet material may be varied. Likewise, the inner diameter of a rod may be varied.

It will now be obvious to one of ordinary skill in the art that with a known thickness and width of a material, in addition to the inner diameter of the rod, the porosity can be calculated in the above manner. Accordingly, where a sheet of material has a known thickness and length, and is crimped and gathered along the length, the space filled by the material can be determined. The unfilled space may be calculated, for example, by taking the inner diameter of the rod. The porosity or unfilled space within the rod can then be calculated as a percentage of the total area of space within the rod from these calculations.

The crimped and gathered sheet of polylactic acid is wrapped within a filter paper 41 to form the aerosol-cooling element 40.

The mouthpiece filter 50 is a conventional mouthpiece filter formed from cellulose acetate, and having a length of about 45 millimetres.

The four elements identified above are assembled by being tightly wrapped within a paper 60. The paper 60 in this specific embodiment is a conventional cigarette paper having standard properties. The interference between the paper 60 and each of the elements locates the elements and defines the rod 11 of the aerosol-generating article 10.

Although the specific embodiment described above and illustrated in FIG. 1 has four elements assembled in a cigarette paper, it is clear than an aerosol-generating article may have additional elements or fewer elements.

An aerosol-generating article as illustrated in FIG. 1 is designed to engage with an aerosol-generating device (not shown) in order to be consumed. Such an aerosol-generating device includes means for heating the aerosol-forming substrate 20 to a sufficient temperature to form an aerosol. Typically, the aerosol-generating device may comprise a heating element that surrounds the aerosol-generating article adjacent to the aerosol-forming substrate 20, or a heating element that is inserted into the aerosol-forming substrate 20.

Once engaged with an aerosol-generating device, a user draws on the mouth-end 12 of the aerosol-generating article 10 and the aerosol-forming substrate 20 is heated to a temperature of about 375 degrees Celsius. At this temperature, volatile compounds are evolved from the aerosol-forming substrate 20. These compounds condense to form an aerosol, which is drawn through the rod 11 towards the user's mouth.

The aerosol is drawn through the aerosol-cooling element 40. As the aerosol passes thorough the aerosol-cooling element 40, the temperature of the aerosol is reduced due to transfer of thermal energy to the aerosol-cooling element 40. Furthermore, water droplets condense out of the aerosol and adsorb to internal surfaces of the longitudinally extending channels defined through the aerosol-cooling element 40.

When the aerosol enters the aerosol-cooling element 40, its temperature is about 60 degrees Celsius. Due to cooling within the aerosol-cooling element 40, the temperature of the aerosol as it exits the aerosol cooling element 40 is about 40 degrees Celsius. Furthermore, the water content of the aerosol is reduced. Depending on the type of material forming the aerosol-cooling element 40, the water content of the aerosol may be reduced from anywhere between 0 and 90%. For example, when element 40 is comprised of polylatic acid, the water content is not considerably reduced, i.e., the reduction will be approximately 0%. In contrast, when the starch based material, such as Mater-Bi, is used to form element 40, the reduction may be approximately 40%. It will now be apparent to one of ordinary skill in the art that through selection of the material comprising element 40, the water content in the aerosol may be chosen.

Aerosol formed by heating a tobacco-based substrate will typically comprise phenolic compounds. Using an aerosol-cooling element consistent with the embodiments discussed herein may reduce levels of phenol and cresols by 90% to 95%.

Figure 2:
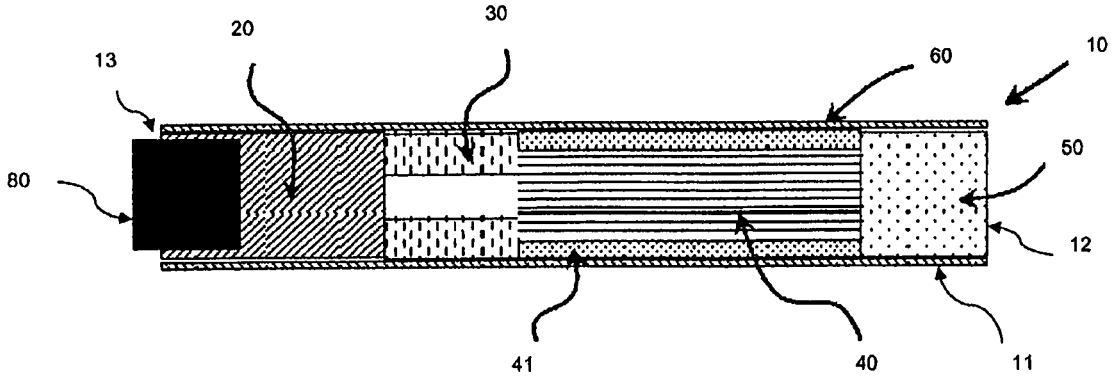
FIG. 2 is a schematic cross-sectional diagram of a second embodiment of an aerosol-generating article.

FIG. 2 illustrates a second embodiment of an aerosol-generating article. While the article of FIG. 1 is intended to be consumed in conjunction with an aerosol-generating device, the article of FIG. 2 comprises a combustible heat source 80 that may be ignited and transfer heat to the aerosol-forming substrate 20 to form an inhalable aerosol. The combustible heat source 80 is a charcoal element that is assembled in proximity to the aerosol-forming substrate at a distal end 13 of the rod 11. The article 10 of FIG. 2 is configured to allow air to flow into the rod 11 and circulate through the aerosol-forming substrate 20 before being inhaled by a user. Elements that are essentially the same as elements in FIG. 1 have been given the same numbering.

The exemplary embodiments described above is not limiting. In view of the above-discussed exemplary embodiments, other embodiments consistent with the above exemplary embodiments will now be apparent to one of ordinary skill in the art.

The following examples record experimental results obtained during tests carried out on specific embodiments of an aerosol-generating article comprising an aerosol-cooling element. Conditions for smoking and smoking machine specifications are set out in ISO Standard 3308 (ISO 3308: 2000). The atmosphere for conditioning and testing is set out in ISO Standard 3402. Phenols were trapped using Cambridge filter pads. Quantitative measurement of phenolics, catechol, hydroquinone, phenol, o-, m- and p-cresol, was done by LC-fluorescence.

EXAMPLE 1

This experiment was performed to assess the effect of incorporation of a crimped and gathered polylactic acid (PLA) aerosol-cooling element in an aerosol-generating article for use with an electrically heated aerosol-generating device. The experiment investigated the effect of the aerosol-cooling element on the puff per puff mainstream aerosol temperature. A comparative study with a reference aerosol-generating article without an aerosol-cooling element is provided.

Materials and Methods

Aerosol-generating runs were performed under a Health Canada smoking regime: 15 puffs were taken, each of 55 mL in volume and 2 seconds puff duration, and having a 30 seconds puff interval. 5 blank puffs were taken before and after a run.

Preheating time was 30 s. During the experiment, the laboratory conditions were (60±4)% relative humidity (RH) and a temperature of (22±1)° C.

Article A is an aerosol-generating article having a PLA aerosol-cooling element. Article B is a reference aerosol-generating article without an aerosol-cooling element.

The aerosol-cooling element is made of 30 μm thick sheet of EarthFirst®PLA Blown Clear Packaging Film made from renewable plant resources and traded under the trade name Ingeo™ (Sidaplax, Belgium). For mainstream aerosol temperature measurement, 5 replicates per sample were measured.

Results

Figure 3:
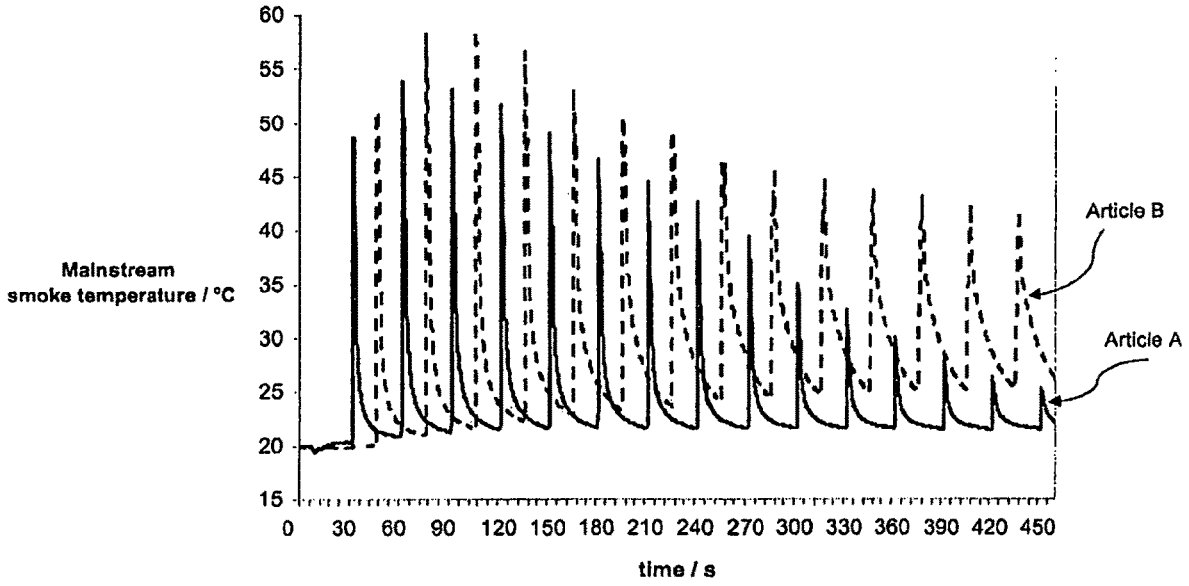
FIG. 3 is a graph illustrating puff per puff mainstream smoke temperature for two different aerosol-generating articles.
Figure 4:
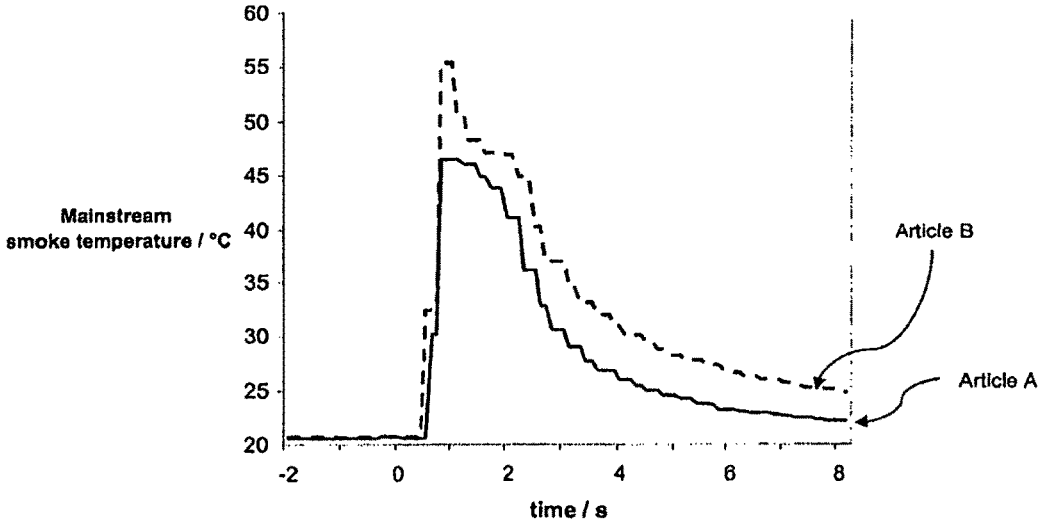
FIG. 4 is a graph comparing intra puff temperature profiles for two different aerosol-generating articles.

The average mainstream aerosol temperature per puff taken from Article A and Article B are shown in FIG. 3. The intra-puff mainstream temperature profile of puff number 1 of Article A and Article B are shown in FIG. 4.

EXAMPLE 2

This experiment was performed to assess the effect of incorporation of a crimped and gathered starch based copolymer aerosol-cooling element in an aerosol-generating article for use with an electrically heated aerosol-generating device. The experiment investigated the effect of the aerosol-cooling element on the puff per puff mainstream aerosol temperature. A comparative study with a reference aerosol-generating article without an aerosol-cooling element is provided.

Materials and Methods

Aerosol-generating runs were performed under a Health Canada smoking regime: 15 puffs were taken, each of 55 mL in volume and 2 seconds puff duration, and having a 30 seconds puff interval. 5 blank puffs were taken before and after a run.

Preheating time was 30 s. During the experiment, the laboratory conditions were (60±4)% relative humidity (RH) and a temperature of (22±1)° C.

Article C is an aerosol-generating article having a starch based copolymer aerosol-cooling element. Article D is a reference aerosol-generating article without an aerosol-cooling element.

The aerosol-cooling element is 25 mm in length and made of a starch based copolyester compound. For mainstream aerosol temperature measurement, 5 replicates per sample were measured.

Results

Figure 5:
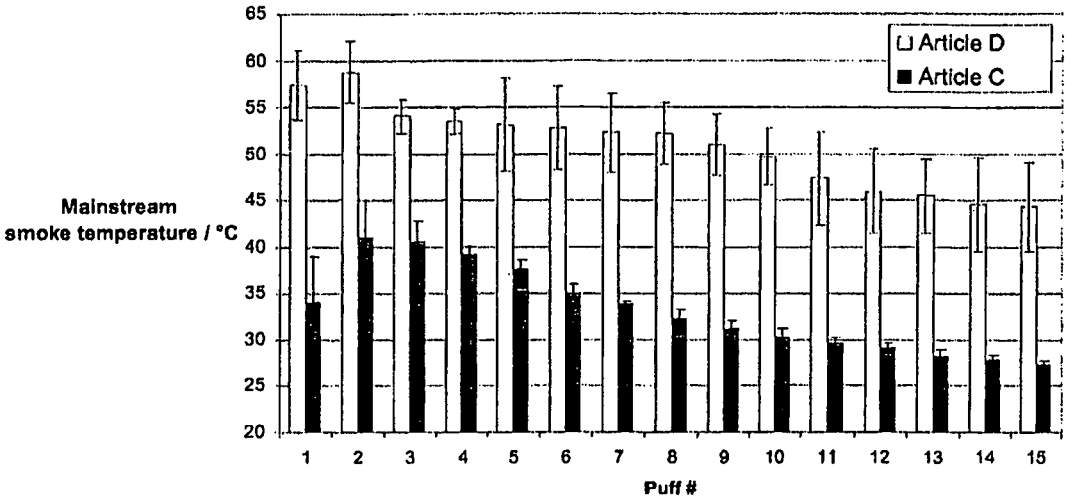
FIG. 5 is a graph illustrating puff per puff mainstream smoke temperature for two different aerosol-generating articles.

The average mainstream aerosol temperature per puff and its standard deviation for both systems (i.e. Articles C and D) are shown in FIG. 5.

The puff per puff mainstream aerosol temperature for the reference system Article D decreases in a quasi linear manner. The highest temperature was reached during puffs 1 and 2 (about 57-58° C.) while the lowest were measured at the end of the smoking run during puffs 14 and 15, and are below 45° C. The use of a starch based copolyester compound crimped and gathered aerosol-cooling element significantly reduces the mainstream aerosol temperature. The average aerosol temperature reduction shown in this specific example is about 18° C., with a maximum reduction of 23° C. during puff number 1 and a minimum reduction of 14° C. during puff number 3.

EXAMPLE 3

In this example, the effect of a polylactic acid aerosol-cooling element on puff per puff mainstream aerosol nicotine and glycerine levels was investigated.

Materials and Methods

Puff per puff nicotine and glycerine deliveries were measured by gas chromatography/time-of-flight mass spectrometry (GC/MS-TOF). Runs were performed as described in example 1. Articles A and B are articles as described in Example 1.

Results

Figure 6:
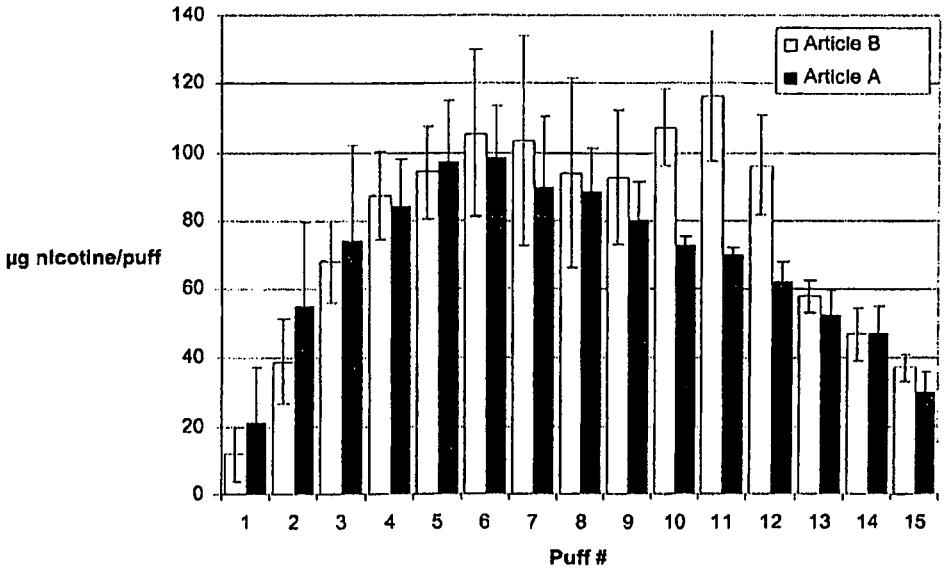
FIG. 6 is a graph illustrating puff per puff mainstream nicotine levels for two different aerosol-generating articles.
Figure 7:
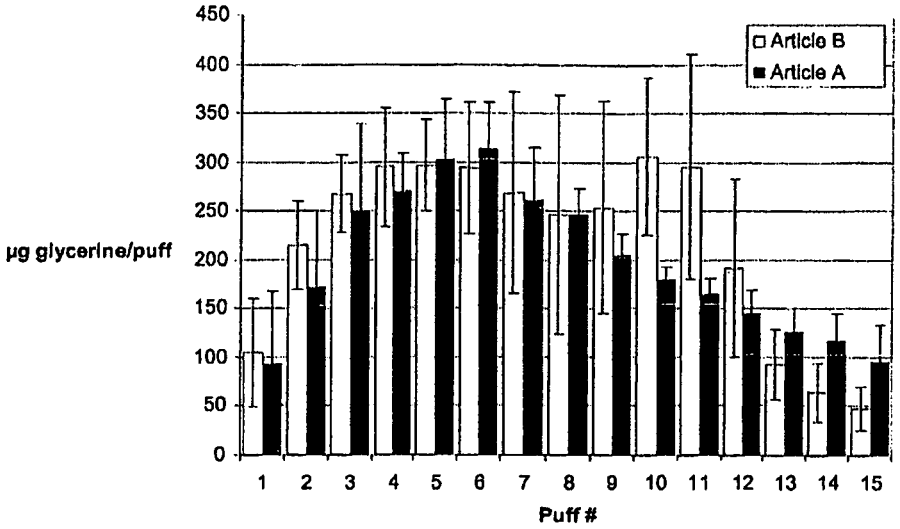
FIG. 7 is a graph illustrating puff per puff mainstream glycerine levels for two different aerosol-generating articles.

Nicotine and glycerine puff per puff release profiles of Article A and Article B are shown in FIGS. 6 and 7.

EXAMPLE 4

In this example, the effect of a starch based copolyester aerosol-cooling element on the puff per puff mainstream aerosol nicotine and glycerine levels was investigated.

Materials and Methods

Puff per puff nicotine and glycerine deliveries are measured by GC/MS-TOF. Runs were performed as described in example 2. Articles C and D are articles as described in Example 1. Articles A and B are articles as described in Example 1.

Figure 8:
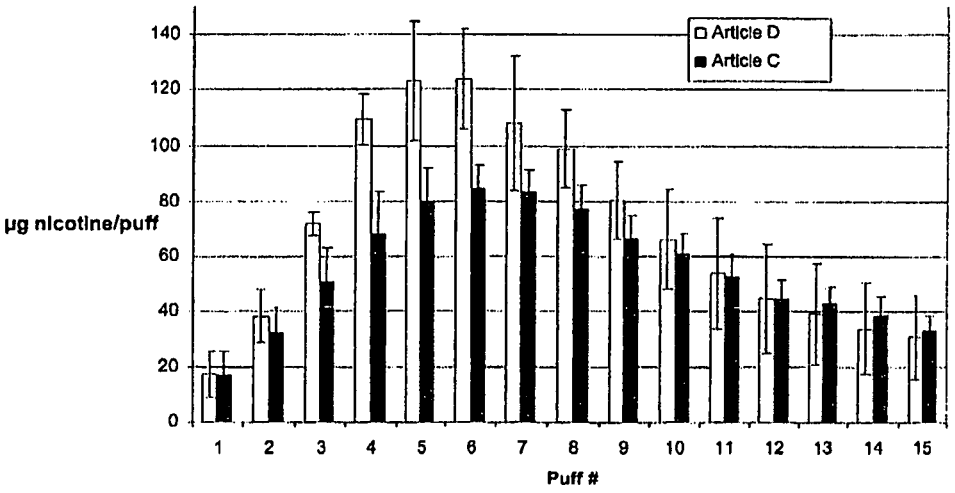
FIG. 8 is a graph illustrating puff per puff mainstream nicotine levels for two different aerosol-generating articles.
Figure 9:
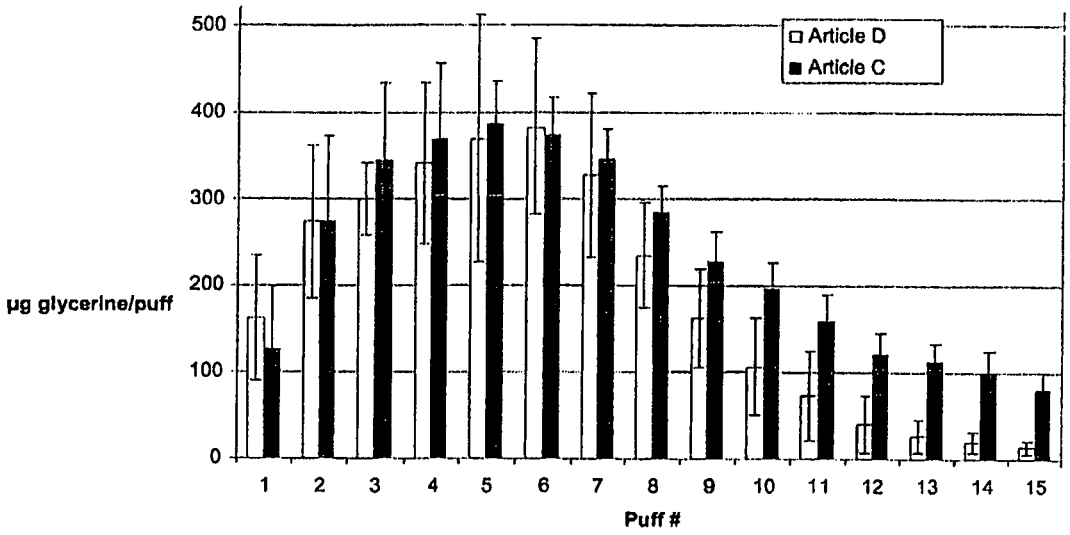
FIG. 9 is a graph illustrating puff per puff mainstream glycerine levels for two different aerosol-generating articles.

Puff per puff nicotine and glycerine deliveries are shown in FIGS. 8 and 9. The total nicotine yields with a starch based copolyester compound crimped filter was 0.83 mg/cigarette ($\sigma$=0.11 mg) and 1.04 mg/cigarette ($\sigma$=0.16 mg). The reduction in nicotine yields is clearly visible in FIG. 8 and occurs mainly between puffs 3 and 8. The use of a starch based copolyester compound aerosol-cooling element reduced the variability in puff per puff nicotine yields (cv=38% with crimped filter, cv=52% without filter). Maximum nicotine yield per single puff is 80 μg with the aerosol-cooling element and up to 120 μg without.

EXAMPLE 5

In this example, the effect of a polylactic acid aerosol-cooling element on the total mainstream aerosol phenol yield was investigated. In addition, the effect of a polylactic acid aerosol-cooling element on mainstream aerosol phenol yields in comparison with international reference cigarette 3R4F, on nicotine base is provided.

Materials and Methods

Analysis of phenols was performed. The number of replicates per prototype was 4. Laboratory conditions and testing regime were as described in example 1. Articles A and B are as described in example 1. Mainstream aerosol phenols yields for the systems with and without the aerosol-cooling element are presented in Table 1. For comparison purposes, mainstream smoke values for the Kentucky reference cigarette 3R4F are also given in Table 1. Kentucky reference cigarette 3R4F is a commercially available reference cigarette available, for example, from the College of Agriculture, Tobacco Research & Development center at the University of Kentucky.

TABLE 1

Mainstream phenols yields for Article B, Article A, and 3R4F reference cigarette. Yields are given in μg/cigarette.

| | Phenol | | o-Cresol | | m-Cresol | | p-Cresol | | Catechol | | Hydroquinone | |
|---|---|---|---|---|---|---|---|---|---|---|---|---|
| | avg | Sd | avg | Sd | Avg | sd | avg | sd | avg | Sd | avg | sd |
| Article B | 7.9 | 0.5 | 0.52 | 0.02 | 0.27 | 0.03 | 0.60 | 0.03 | 7.4 | 0.8 | 5.0 | 0.6 |
| Article A | <0.6 | — | 0.18 | 0.01 | <0.15 | — | <0.29 | — | 8.6 | 0.8 | 5.0 | 0.9 |
| 3R4F | 11.7 | 0.6 | 3.9 | 0.2 | 3.1 | 0.1 | 7.9 | 0.4 | 83.9 | 2.1 | 78.1 | 2.4 |

The most dramatic effect of the addition of a PLA aerosol-cooling element in this specific example is observed for phenol, where the reduction in phenol is greater than 92% versus the reference system without an aerosol cooling element, and 95% versus the 3R4F reference cigarette (expressed on a per mg of nicotine basis). The phenols yields (in nicotine basis) reduction percentages are given in Table 2 expressed per mg of nicotine.

TABLE 2

Phenols yields reduction (in nicotine basis) expressed in %.

| | Phenol % reduction | o-Cresol % reduction | m-Cresol % reduction | p-Cresol % reduction | Catechol % reduction | Hydroquinone % reduction |
|---|---|---|---|---|---|---|
| Article A vs. Article B | >91 | 60 | >36 | >45 | +32 | +13 |
| Article A vs. 3R4F | >89 | 90 | >90 | >92 | 79 | 86 |

Figure 10:
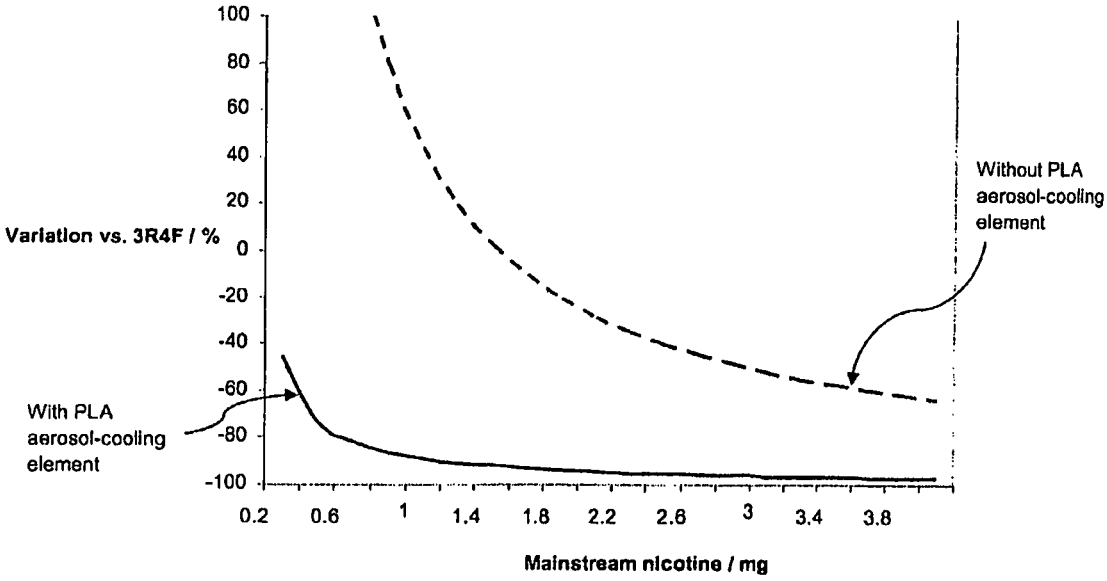
FIG. 10 is a graph comparing mainstream nicotine levels between an aerosol-generating article and a reference cigarette.

The variation of the mainstream smoke phenol yields versus 3R4F (in nicotine basis) as a function of the mainstream smoke deliveries is given in FIG. 10.

EXAMPLE 6

In this example, the effect of a polylactic acid aerosol-cooling element on the puff per puff mainstream smoke phenol yield was investigated.

Materials and Methods

Analysis of phenols was performed. Number of replicates per prototype was 4. Conditions were as described in example 1. Articles A and B are as described in example 1.

Results

Phenol and nicotine puff per puff profiles for Articles A and B are given in FIGS. 8 and 9. For the system of Article B, mainstream aerosol phenol was detected as of puff number 3 and reached a maximum as of puff number 7. The effect of the PLA aerosol-cooling element on the puff per puff phenol deliveries is clearly visible, since phenol deliveries are below the limit of detection (LOD). A reduction in the total yield of nicotine and a flattening of the puff per puff nicotine release profile was observed in FIG. 9.

The invention claimed is:

1. A heated aerosol-generating article, comprising:

a plurality of elements assembled in the form of a rod by means of a paper wrapper, the plurality of elements including an aerosol-forming substrate, an aerosol-cooling element located downstream from the aerosol-forming substrate within the rod, and a mouthpiece filter located downstream from the aerosol-cooling element within the rod, wherein a first end of the mouthpiece filter forms a mouth end of the rod and the aerosol-cooling element is disposed adjacent a second end of the mouthpiece filter, the rod further comprises a spacer element located between the aerosol-forming substrate and the aerosol-cooling element within the rod, the aerosol-forming substrate being disposed immediately adjacent to the spacer element, outer surfaces of each of the aerosol-forming substrate, the spacer element, the aerosol-cooling element, and the mouthpiece filter abut an inner surface of the paper wrapper, the aerosol-forming substrate is formed from a homogenised tobacco material having an aerosol former content of between 5% and 30% by weight on a dry weight basis, and in which the aerosol-cooling element is formed from a polymeric sheet that has been crimped such that the polymeric sheet has a plurality of parallel ridges and corrugations that, in the heated aerosol-generating article, extend in a longitudinal direction therein, and gathered such that the aerosol-cooling element comprises a plurality of longitudinally extending channels and has a longitudinal porosity of between 50% and 90% in the longitudinal direction, the longitudinal porosity being derived from a ratio of a cross-sectional area of material forming the aerosol-cooling element and an internal cross-sectional area of the heated aerosol-generating article at a portion containing the aerosol-cooling element, the aerosol-cooling element has a total surface area of between 300 $mm^2$ per mm length of the aerosol-cooling element and 1000 $mm^2$ per mm length of the aerosol-cooling element, the external diameter of the article is between 5 mm and 12 mm, wherein the aerosol-cooling element comprises a polymeric sheet material formed of polylactic acid, a temperature of a stream of aerosol drawn through the aerosol-cooling element is lowered by more than 20° C., and a water vapor content of an aerosol stream drawn through the aerosol-cooling element is lowered by between about 20% and about 90%.

2. The heated aerosol-generating article according to claim 1, wherein the aerosol-cooling element is between about 7 mm and about 28 mm in length.

3. The heated aerosol-generating article according to claim 1, wherein the aerosol former includes glycerine and propylene glycol.

4. The heated aerosol-generating article according to claim 1, wherein the spacer element is a tube.

5. The heated aerosol-generating article according to claim 4, wherein the tube is a hollow acetate tube.

* * * * *